US011017931B2

(12) United States Patent
Kang et al.

(10) Patent No.: US 11,017,931 B2
(45) Date of Patent: May 25, 2021

(54) COIL COMPONENT

(71) Applicant: SAMSUNG ELECTRO-MECHANICS CO., LTD., Suwon-si (KR)

(72) Inventors: Byung Soo Kang, Suwon-si (KR); Yong Hui Li, Suwon-si (KR); Byeong Cheol Moon, Suwon-si (KR); Yoon Mi Cha, Suwon-si (KR); Eun Jin Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 244 days.

(21) Appl. No.: 16/158,701

(22) Filed: Oct. 12, 2018

(65) Prior Publication Data

US 2019/0311829 A1 Oct. 10, 2019

(30) Foreign Application Priority Data

Apr. 10, 2018 (KR) ..... 10-2018-0041461

(51) Int. Cl.

| | |
|---|---|
| ***H01F 5/00*** | (2006.01) |
| ***H01F 17/00*** | (2006.01) |
| ***H01F 17/04*** | (2006.01) |
| ***H01F 3/10*** | (2006.01) |
| ***H01F 27/29*** | (2006.01) |
| ***H01F 1/14*** | (2006.01) |

(Continued)

(52) U.S. Cl.

CPC ..... *H01F 17/0013* (2013.01); *H01F 1/14* (2013.01); *H01F 3/10* (2013.01); *H01F 17/04* (2013.01); *H01F 27/02* (2013.01); *H01F 27/255* (2013.01); *H01F 27/292* (2013.01); *H01F 27/36* (2013.01); *H01F 41/041* (2013.01)

(58) Field of Classification Search

USPC ..... 336/200

See application file for complete search history.

(56) References Cited

U.S. PATENT DOCUMENTS

2013/0057112 A1 3/2013 Shirakawa et al.
2017/0256353 A1* 9/2017 Park ..... H01F 17/04

(Continued)

FOREIGN PATENT DOCUMENTS

CN 107210129 A 9/2017
JP 2005-310863 A 11/2005

(Continued)

OTHER PUBLICATIONS

Office Action issued in Korean Patent Application No. 10-2018-0041461 dated Apr. 23, 2019, with English translation.

(Continued)

*Primary Examiner* — Ronald Hinson

(74) *Attorney, Agent, or Firm* — Morgan, Lewis & Bockius LLP

(57) ABSTRACT

A coil component includes a body, a coil part embedded in the body, and an insulating layer covering the body. First and second plating electrodes are disposed between the body and the insulating layer, are connected to the coil part, and are disposed to be spaced apart from each other on one surface of the body. First and second through electrodes penetrate through the insulating layer to thereby be connected to the first and second plating electrodes, respectively.

15 Claims, 10 Drawing Sheets

I–I'

(51) Int. Cl.

| | |
|---|---|
| ***H01F 27/02*** | (2006.01) |
| ***H01F 27/255*** | (2006.01) |
| ***H01F 41/04*** | (2006.01) |
| ***H01F 27/36*** | (2006.01) |

(56) References Cited

U.S. PATENT DOCUMENTS

| | | | | |
|---|---|---|---|---|
| 2017/0271081 | A1 | 9/2017 | Maki et al. | |
| 2017/0323725 | A1* | 11/2017 | Iso | H01F 41/046 |

FOREIGN PATENT DOCUMENTS

| | | | |
|---|---|---|---|
| JP | 2013-058558 | A | 3/2013 |
| KR | 10-2014-0054794 | A | 5/2014 |
| KR | 10-2017-0084156 | A | 7/2017 |
| KR | 10-2018-0028374 | A | 3/2018 |

OTHER PUBLICATIONS

Office Action issued in corresponding Chinese Patent Application No. 201811555091.X dated Feb. 2, 2021, with English translation.

* cited by examiner

I–I'

II–II'

I–I'

COIL COMPONENT

CROSS-REFERENCE TO RELATED APPLICATION(S)

This application claims benefit of priority to Korean Patent Application No. 10-2018-0041461 filed on Apr. 10, 2018 in the Korean Intellectual Property Office, the disclosure of which is incorporated herein by reference in its entirety.

BACKGROUND

1. Field

The present disclosure relates to a coil component.

2. Description of Related Art

An inductor is a coil component and a representative passive electronic component commonly used in electronic devices together with resistors and capacitors.

In accordance with enabling high performance and miniaturization of the electronic devices, the numbers of electronic components used in electronic devices have increased while the individual components decreased in size.

Due to the above-mentioned reason, requirements for removing noise generation sources such as electromagnetic interference (EMI) of the electronic components have gradually increased.

SUMMARY

An aspect of the present disclosure may provide a coil component in which a shielding structure decreasing a leakage magnetic flux may be easily formed.

According to an aspect of the present disclosure, a coil component may include a body, a coil part embedded in the body, and an insulating layer covering the body. Additionally, first and second plating electrodes are disposed between the body and the insulating layer, connected to the coil part, and disposed to be spaced apart from each other on one surface of the body. First and second through electrodes penetrate through the insulating layer to thereby be connected to the first and second plating electrodes, respectively.

According to a further aspect of the present disclosure, a coil component includes a coil part embedded in a body and having ends exposed to opposing end surfaces of the body, first and second plating electrodes each disposed on a respective end surface of the opposing end surfaces of the body to connect to a respective end of the coil part, and an insulating layer disposed to cover an entire surface of each of the first and second plating electrodes parallel to the opposing end surfaces of the body.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
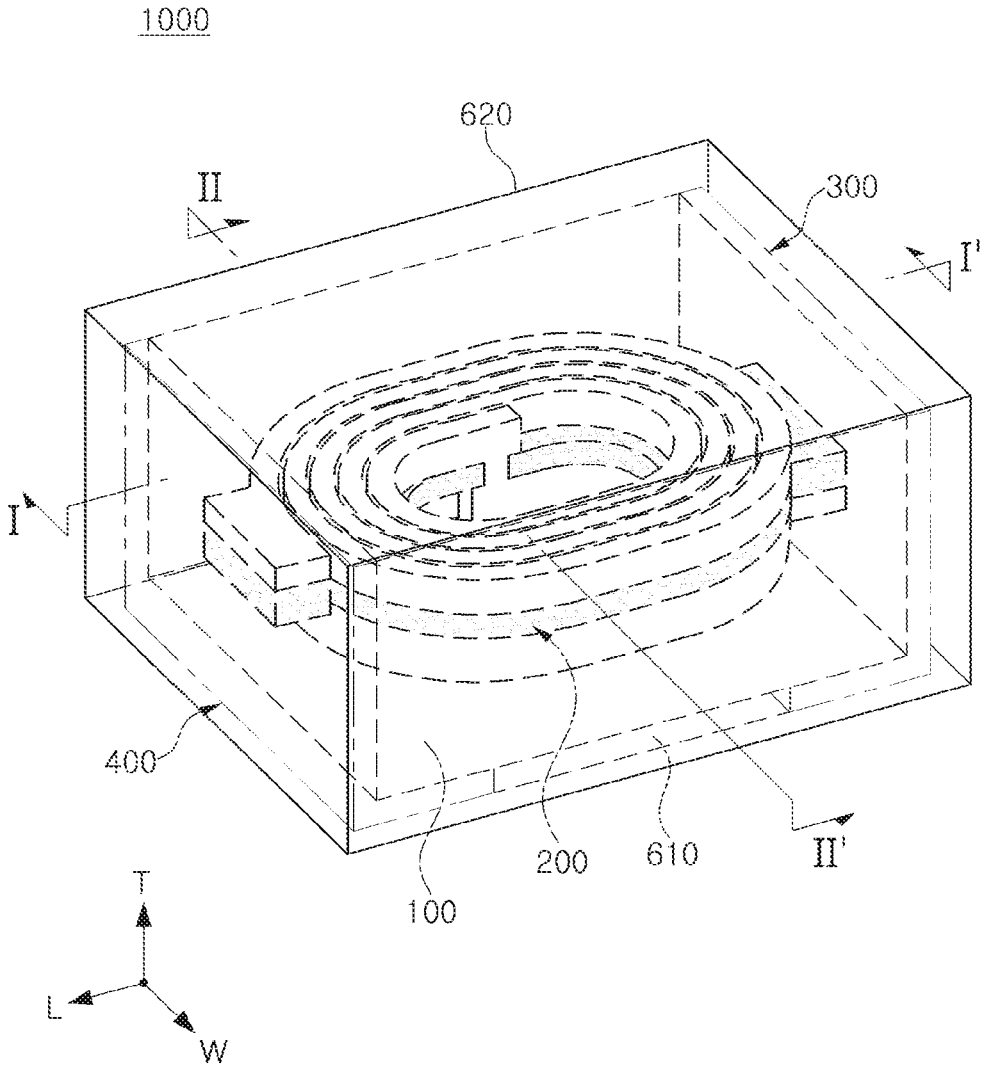
FIG. 1 is a perspective view schematically illustrating a coil component according to an exemplary embodiment.

Hereinafter, exemplary embodiments of the present disclosure will be described in detail with reference to the accompanying drawings.

In the accompanying drawings, an L direction refers to a first direction or a length direction, a W direction refers to a second direction or a width direction, and a T direction refers to a third direction or a thickness direction.

Hereinafter, a coil component according to an exemplary embodiment will be described in detail with reference to the accompanying drawings. In describing an exemplary embodiment with reference to the accompanying drawings, components that are the same as or correspond to each other will be denoted by the same reference numerals, and an overlapped description thereof will be omitted.

Various kinds of electronic components are used in an electronic device, and various kinds of coil components may be appropriately used for the purpose of removing noise, or the like, between the electronic components.

That is, the coil component may be used as a power inductor, a high-frequency (HF) inductor, a general bead, a GHz bead, a common mode filter, and the like, in the electronic device.

Coil Component

Figure 2:
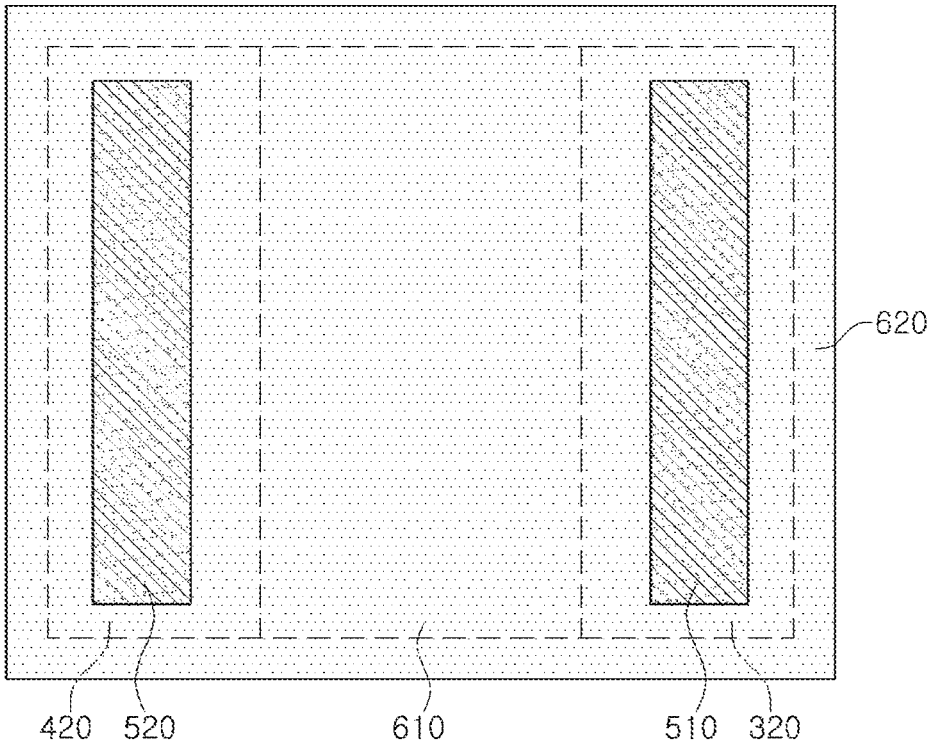
FIG. 2 is a bottom view schematically illustrating the coil component of FIG. 1 according to the exemplary embodiment.
Figure 3:
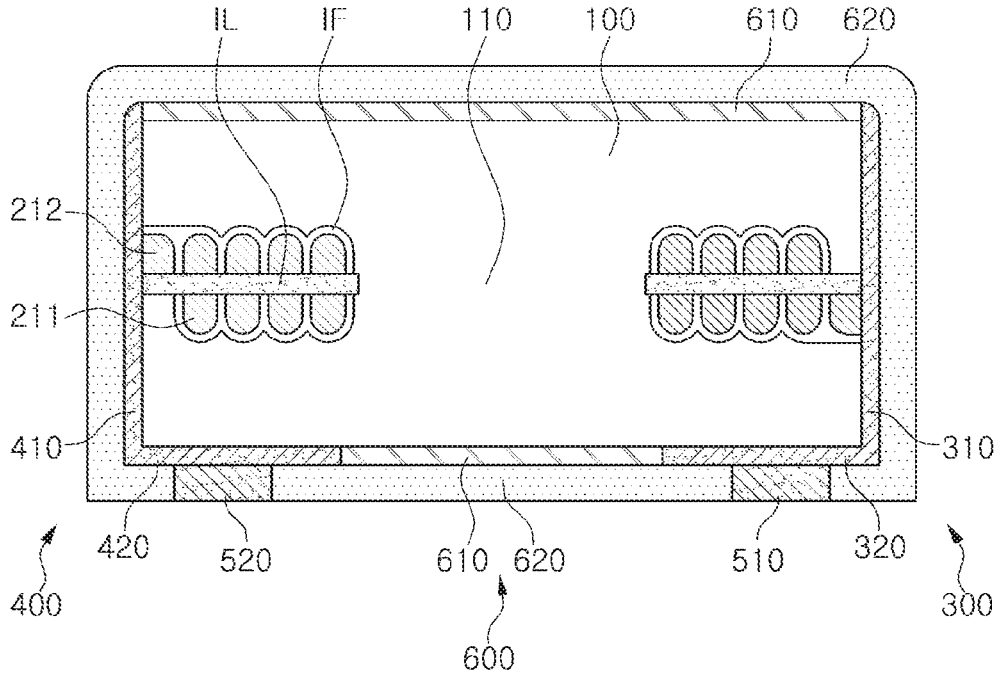
FIG. 3 is a cross-sectional view taken along line I-I' of FIG. 1.
Figure 4:
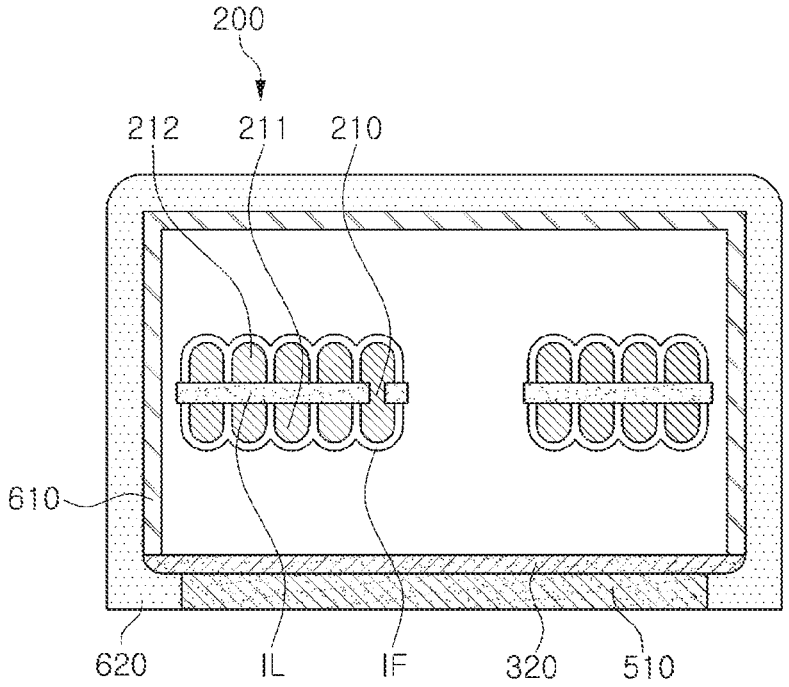
FIG. 4 is a cross-sectional view taken along line II-II' of FIG. 1.

FIG. 1 is a perspective view schematically illustrating a coil component according to an exemplary embodiment. FIG. 2 is a bottom view schematically illustrating the coil component according to the exemplary embodiment. FIG. 3 is a cross-sectional view taken along line I-I' of FIG. 1. FIG. 4 is a cross-sectional view taken along line II-II' of FIG. 1.

Referring to FIGS. 1 through 4, a coil component 1000 according to the exemplary embodiment may include a body 100, a coil part 200, first and second plating electrodes 300 and 400, first and second through electrodes 510 and 520, and an insulating layer 600.

The body 100 may form an exterior of the coil component 1000 according to the present exemplary embodiment, and the coil part 200 may be embedded therein.

The body 100 may be formed in an entirely hexahedral shape.

Hereinafter, as an example, the first exemplary embodiment will be described on the assumption that the body 100 has a hexahedral shape. However, a coil component including a body formed in a shape other than the hexahedral shape is not excluded in the scope of the present exemplary embodiment by the description.

The body 100 may have first and second surfaces opposing each other in the length (L) direction, third and fourth surfaces opposing each other in the width (W) direction, and fifth and sixth surfaces opposing each other in the thickness (T) direction. The first to fourth surfaces of the body 100 may correspond to wall surfaces of the body 100 connecting the fifth and sixth surfaces of the body 100 to each other. The wall surfaces of the body 100 may include the first and second surfaces corresponding to both end surfaces and the third and fourth surfaces corresponding to both side surfaces opposing each other.

For example, the body 100 may be formed so that the coil component 1000 in which plating electrodes 300 and 400 and an insulating layer 600 to be described below are formed has a length of 2.0 mm, a width of 1.2 mm, and a thickness of 0.65 mm, but the body 100 is not limited thereto. Meanwhile, the above-mentioned numerical values of the length, the width, and the thickness of the coil component are values without considering tolerances and an actual length, an actual width, and an actual thickness of the coil component may be different from the numerical values described above by the tolerances.

The body 100 may contain a magnetic material and a resin. More specifically, the body may be formed by stacking one or more magnetic composite sheets in which the magnetic material is dispersed in the resin. However, the body 100 may also have a different structure other than a structure in which the magnetic material is dispersed in the resin. For example, the body 100 may also be formed of a magnetic material such as ferrite.

The magnetic material may be ferrite or a metal magnetic powder.

As an example, the ferrite may be at least one selected from spinel type ferrite such as Mg—Zn based ferrite, Mn—Zn based ferrite, Mn—Mg based ferrite, Cu—Zn based ferrite, Mg—Mn—Sr based ferrite, and Ni—Zn based ferrite; hexagonal ferrite such as Ba—Zn based ferrite, Ba—Mg based ferrite, Ba—Ni based ferrite, Ba—Co based ferrite, and Ba—Ni—Co based ferrite; garnet type ferrite such as Y based ferrite; and Li based ferrite.

The metal magnetic powder may contain one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder may be at least one of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, and Fe—Cr—Al based alloy powder.

The metal magnetic powder may be amorphous or crystalline. For example, the metal magnetic powder may be Fe—Si—B—Cr based amorphous alloy powder, but is not necessarily limited thereto.

The ferrite particles and the metal magnetic powder particles may each have an average diameter of about 0.1 μm to 30 μm, but are not limited thereto.

The body 100 may contain two or more kinds of magnetic materials dispersed in the resin. Here, the phrase "different kinds of magnetic materials" means that the magnetic materials dispersed in the resin are distinguished from each other in any one or more of an average diameter, a composition, crystallinity, and a shape thereof.

The resin may include one or a mixture of epoxy, polyimide, a liquid crystal polymer (LCP), and the like, but is not limited thereto.

The body 100 may include a core 110 penetrating through a coil part 200 to be described below. The core 110 may be formed by filling the magnetic composite sheet in a through hole of the coil part 200, but is not limited thereto.

The coil part 200 may be embedded in the body 100 and exhibit characteristics of the coil component. For example, when the coil component 1000 is used as a power inductor, the coil part 200 may serve to stabilize a power source of an electronic device by storing an electric field as a magnetic field to maintain an output voltage.

The coil part 200 may include a first coil pattern 211, a second coil pattern 212, and a via 210.

The first and second coil patterns 211 and 212 and an internal insulating layer IL to be described below may be formed to be sequentially stacked in the thickness (T) direction of the body 100.

Each of the first and second coil patterns 211 and 212 may be formed in a flat spiral shape. As an example, the first coil pattern 211 may form at least one turn on one surface of the internal insulating layer IL centered on the thickness (T) direction of the body 100. As a further example, the second coil pattern 212 may form at least one turn on another surface (e.g., opposite the one surface) of the internal insulating layer IL centered on the thickness (T) direction of the body 100.

The via 210 may penetrate through the internal insulating layer IL so as to electrically connect the first and second coil patterns 211 and 212 to each other, thereby coming in contact with each of the first and second coil patterns 211 and 212. As a result, the coil part 200 applied in the present exemplary embodiment may be formed as a single coil generating a magnetic field in the thickness (T) direction of the body 100.

At least one of the first and second coil patterns 211 and 212 and the via 210 may include at least one conductive layer.

As an example, when the second coil pattern 212 and the via 210 are formed by plating, each of the second coil pattern 212 and the via 210 may include a seed layer of an electroless plating layer and an electroplating layer. Here, the electroplating layer may have a monolayer structure or a multilayer structure. The electroplating layer having the multilayer structure may also be formed in a conformal film structure in which one electroplating layer is covered with another electroplating layer. Alternatively, the electroplating layer having the multilayer structure may also be formed so that only on one surface of one electroplating layer, another plating layer is stacked. The seed layer of the second coil pattern 212 and the seed layer of the via 210 may be formed integrally with each other so that a boundary therebetween is not formed, but the seed layer of the second coil pattern 212 and the seed layer of the via 210 are not limited thereto. The electroplating layer of the second coil pattern 212 and the electroplating layer of the via 210 may be formed integrally with each other so that a boundary therebetween is not formed, but the electroplating layer of the second coil pattern 212 and the electroplating layer of the via 210 are not limited thereto.

As another example, when the coil part 200 is formed by separately forming the first and second coil patterns 211 and 212 and then collectively stacking the first and second coil patterns 211 and 212 on the internal insulating layer IL, the via 210 may include a high-melting point metal layer and a low-melting point metal layer having a melting point lower than that of the high-melting point metal layer. Here, the low-melting point metal layer may be formed of solder containing lead (Pb) and/or tin (Sn). The low-melting point metal layer may be at least partially melted by a pressure and a temperature at the time of collective stacking, such that an inter-metallic compound (IMC) layer may be formed in a boundary between the low-melting point metal layer and the second coil pattern 212.

As an example, the first and second coil patterns 211 and 212 may be formed to protrude on lower and upper surfaces of the internal insulating layer (IL), respectively. As another example, the first coil pattern 211 may be embedded in the lower surface of the internal insulating layer IL so that a lower surface thereof is exposed through the lower surface of the internal insulating layer IL, and the second coil pattern 212 may be formed to protrude on the upper surface of the internal insulating layer IL. In this case, a concave portion may be formed in the lower surface of the first coil pattern 211, such that the lower surface of the internal insulating layer IL and the lower surface of the first coil pattern 211 may not be positioned on the same plane. As another example, the first coil pattern 211 may be embedded in the lower surface of the internal insulating layer IL so that a lower surface thereof is exposed through the lower surface of the internal insulating layer IL, and the second coil pattern 212 may be embedded in the upper surface of the internal insulating layer IL so that an upper surface thereof is exposed through the upper surface of the internal insulating layer IL.

End portions of the first and second coil patterns 211 and 212 may be exposed to the first and second surfaces of the body 100, respectively. The end portion of the first coil pattern 211 exposed to the first surface of the body 100 may come in contact with a first connection portion 310 of a first plating electrode 300 to be described below, such that the first coil pattern 211 may be electrically connected to the first plating electrode 300. The end portion of the second coil pattern 212 exposed to the second surface of the body 100 may come in contact with a second connection portion 410 of a second plating electrode 400 to be described below, such that the second coil pattern 212 may be electrically connected to the second plating electrode 400.

The first and second coil patterns 211 and 212 and the via 210 may each be formed of a conductive material such as copper (Cu), aluminum (Al), silver (Ag), tin (Sn), gold (Au), nickel (Ni), lead (Pb), titanium (Ti), or alloys thereof, but are not limited thereto.

The internal insulating layer IL may be formed of an insulating material including at least one of thermosetting insulating resins such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer IL may be formed of an insulating material such as prepreg, an Ajinomoto build-up film (ABF), FR-4, a bismaleimide triazine resin, a photoimageable dielectric (PID), or the like, but is not limited thereto.

As the inorganic filler, at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material containing a reinforcing material, the internal insulating layer IL may provide excellent rigidity. When the internal insulating layer IL is formed of an insulating material that does not contain glass fiber, the internal insulating layer IL is advantageous for thinning a thickness of the entire coil part 200. When the internal insulating layer IL is formed of an insulating material containing a photosensitive insulating resin, the number of processes may be decreased, which is advantageous for decreasing a manufacturing cost, and a fine hole may be formed.

The insulating film IF may be formed along surfaces of the first coil pattern 211, the internal insulating layer IL, and the second coil pattern 212. The insulating film IF may be formed in order to protect and insulate the respective coil patterns 211 and 212 and contain an insulating material known in the art such as parylene, or the like. Any insulating material may be contained in the insulating film IF without particular limitation. The insulating film IF may be formed by a method such as a vapor deposition method, or the like, but is not limited thereto. The insulating film may be formed by stacking an insulation film on both surfaces of the internal insulating layer IL on which the first and second coil patterns 211 and 212 are formed.

Meanwhile, although not illustrated, at least one of the first and second coil patterns 211 and 212 may be formed in plural. As an example, the coil part 200 may have a structure in which a plurality of first coil patterns 211 are formed, and another first coil pattern is stacked on a lower surface of one first coil pattern. In this case, an additional insulating layer may be disposed between the plurality of first coil patterns 211, and the plurality of first coil patterns 211 may be connected to each other by one or more connection via(s) each penetrating through the additional insulating layer, but the first coil pattern 211 is not limited thereto.

The insulating layer 600 may cover the body. That is, the insulating layer 600 may be disposed on the first to sixth surfaces of the body 100.

The insulating layer 600 may include a plating prevention layer 610 formed on the surface of the body 100 except for regions of the surface of the body 100 on which first and second plating electrodes 300 and 400 to be described below are formed, and a cover layer 620 covering the plating prevention layer 610 and the first and second plating electrodes 300 and 400. Since first and second plating electrodes 300 and 400 are formed on the first and second surfaces of the body 100 and portions of the sixth surface thereof, the plating prevention layer 610 may be formed on the third to fifth surfaces of the body 100 and one region of the sixth surface of the body 100 on which the first and second plating electrodes 300 and 400 are not formed.

The plating prevention layer 610 may serve as a plating resist in forming first and second plating electrodes 300 and 400 to be described below by plating, but is not limited thereto.

Opening portions (0 in FIGS. 9A and 9B) may be provided in which first and second through electrodes 510 and 520 to be described below may be formed in the cover layer 620.

The insulating layer 600 may contain a thermoplastic resin such as a polystyrene based thermoplastic resin, a vinyl acetate based thermoplastic resin, a polyethylene based thermoplastic resin, a polypropylene based thermoplastic resin, a polyamide based thermoplastic resin, a rubber based thermoplastic resin, an acrylic based thermoplastic resin, or the like, a thermosetting resin such as a phenolic thermosetting resin, an epoxy based thermosetting resin, a urethane based thermosetting resin, a melamine based thermosetting resin, an alkyd based thermosetting resin, or the like, a photosensitive resin, parylene, $SiO_x$, or $SiN_x$.

The insulating layer 600 may have an adhesion function. As an example, in a case of stacking an insulation film on the body 100 to form the insulating layer 600, the insulation film may contain an adhesive ingredient to adhere to the surface of the body 100. In this case, an adhesive layer may be separately formed on one surface of the insulating layer 600. However, as in a case of forming the insulating layer 600 using a B-stage insulation film, or the like, a separate adhesive layer may not be formed on one surface of the insulating layer 600.

The insulating layer 600 may be formed by applying a liquid insulating resin on the surface of the body 100, stacking an insulation film on the surface of the body 100, or forming an insulating resin on the surface of the body 100 by vapor deposition. In the case of the insulation film, a dry film (DF) including a photosensitive insulating resin, an Ajinomoto build-up film (ABF) that does not contain a photosensitive insulating resin, a polyimide film, or the like, may be used.

The insulating layer 600 may be formed to have a thickness in a range of 10 nm to 100 μm. When the thickness of the insulating layer 600 is less than 10 nm, characteristics of the coil component may be deteriorated, that is, a Q factor, a break down voltage, a self-resonance frequency (SRF), and the like, may be decreased, and when the thickness of the insulating layer 600 is more than 100 μm, a total length, a total width, and a total thickness of the coil component may be increased, which may be disadvantageous for thinning or miniaturizing an electronic device.

The plating electrodes 300 and 400 may be formed between the body 100 and the insulating layer 600, connected to the coil part 200, and disposed on a same surface of the body 100 to be spaced apart from each other. More specifically, the plating electrodes 300 and 400 may both be disposed on the sixth surface of the body to be spaced apart from each other, and covered by the cover layer 620.

The plating electrodes 300 and 400 may include a first plating electrode 300 connected to the first coil pattern 211 and a second plating electrode 400 connected to the second coil pattern 212. More specifically, according to the present exemplary embodiment, the first plating electrode 300 may include a first connection portion 310 disposed on the first surface of the body 100 and connected to the end portion of the first coil pattern 211 and a first extension portion 320 extended from the first connection portion 310 and disposed on the sixth surface of the body 100. The second plating electrode 400 may include a second connection portion 410 disposed on the second surface of the body 100 and connected to the end portion of the second coil pattern 212 and a second extension portion 420 extended from the second connection portion 410 and disposed on the sixth surface of the body 100. The first extension portion 320 and the second extension portion 420 each disposed on the sixth surface of the body 100 may be spaced apart from each other so that the first and second plating electrodes 300 and 400 do not come in contact with each other. That is, the first and second plating electrodes 300 and 400 may each be formed in an L shape.

Meanwhile, although a case is described above in which the end portions of the first and second coil patterns 211 and 212 are exposed to the first and second surfaces of the body 100, respectively, and the plating electrodes 300 and 400 are formed in the "L" shape, the shape of the plating electrodes 300 and 400 are not limited thereto. That is, unlike the above-described case, when the end portions of the first and second coil patterns 211 and 212 are each exposed to the sixth surface of the body 100, the plating electrodes 300 and 400 may be formed only on the sixth surface of the body 100 to thereby be connected to the end portions of the first and second coil patterns 211 and 212, respectively. Further, even though the end portions of the first and second coil patterns 211 and 212 are exposed to the first and second surfaces of the body 100, respectively, the plating electrodes 300 and 400 may not have the "L" shape. As an example, the first plating electrode 300 may also be formed in a "E" shape to include a first connection portion 310 disposed on the first surface of the body 100 and connected to the end portion of the first coil pattern 211, a first extension portion 320 extended from the first connection portion 310 and disposed on the sixth surface of the body 100, and a first band portion extended from the first connection portion 310 and disposed on the fifth surface of the body 100. Further, the first band portion may also be formed on the third and fourth surfaces of the body 100, such that the first plating electrode 300 may be formed as a five-face electrode.

The plating electrodes 300 and 400 may be formed on the surface of the body 100 by performing electroplating using the plating prevention layer 610 on the surface of the body 100 as the plating resist. When the body 100 contains metal magnetic powder, the metal magnetic powder may be exposed to the surface of the body 100. At the time of electroplating, the surface of the body 100 may exhibit conductivity due to the metal magnetic powder exposed to the surface of the body 100, and the plating electrodes 300 and 400 may be formed on the surface of the body 100 by the electroplating.

The connection portions 310 and 410 and the extension portions 320 and 420 of the plating electrodes 300 and 400 may be formed by the same plating process, such that there is no boundary therebetween. That is, the first connection portion 310 and the first extension portion 320 may be formed integrally with each other, and the second connection portion 410 and the second extension portion 420 may be formed integrally with each other. However, this description is not to exclude from the scope of the present disclosure a case in which the connection portions 310 and 410 and the extension portions 320 and 420 are formed by different plating processes and thus a boundary is formed therebetween.

The plating electrodes 300 and 400 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The plating electrodes 300 and 400 may be formed to have a thickness of 0.5 μm to 100 μm. When the thickness of the plating electrodes 300 and 400 is less than 0.5 μm, detachment and delamination may occur at the time of mounting the coil component on a board. When the thickness of the plating electrodes 300 and 400 is more than 100 μm, the thickness may be disadvantageous for thinning an electronic device.

The through electrodes 510 and 520 may penetrate through the insulating layer 600 to thereby be connected to the first and second plating electrodes 300 and 400, respectively. More specifically, a first through electrode 510 may penetrate through the cover layer 620 of the insulating layer 600 to come in contact with the first extension portion 320 of the first plating electrode 300, and a second through electrode 520 may penetrate through the cover layer 620 of the insulating layer 600 to come in contact with the second extension portion 420 of the second plating electrode 400. The first and second through electrodes 510 and 520 may be disposed on the sixth surface of the body 100 to be spaced apart from each other.

The through electrodes 510 and 520 may electrically connect the coil component 1000 to a printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the through electrodes 510 and 520 disposed on the sixth surface of the body 100 and a connection portion of the printed circuit board may be electrically connected to each other by solder, or the like.

The through electrodes 510 and 520 may contain one or more selected from the group consisting of nickel (Ni), copper (Cu), tin (Sn), iron (Fe), platinum (Pt), and gold (Au). As an example, the through electrodes 510 and 520 may be formed by at least one of an electroplating method, a sputtering method, and a paste printing method.

Although a case in which cross-sections of the through electrodes 510 and 520 have a rectangular shape is illustrated in FIG. 2, this is only an example. Therefore, a shape of the cross-sections of the through electrodes 510 and 520 may be variously changed to a polygon, a circle, an oval, and the like. Further, as an example, the cross-sections of the through electrodes 510 and 520 may be formed in a shape including a curve such as a rectangle having a curved edge. Further, the first and second through electrodes 510 and 520 may have the same shape as each other as illustrated in FIG. 2, but may alternatively have different shapes from each other.

Sizes of the through electrodes 510 and 520 and a spaced distance (pitch) between the through electrodes 510 and 520 may be variously changed depending on a size of the coil component, a pitch between pads of a printed circuit board on which the coil component will be mounted, a size of a connection unit such as a solder connecting the coil component and the printed circuit board, or the like.

In this way, a shielding structure may be easily formed in the coil component 1000 according to the present exemplary embodiment, and the coil component 1000 may be easily mounted. That is, since the first and second through electrodes 510 and 520 applied with different polarities from each other are disposed together on the sixth surface of the body 100, the coil component 1000 may be easily mounted. Further, since the cover layer 620 is formed on the first to fifth surfaces of the body 100 other than the mounting surface, even though a conductive shielding structure is formed on the cover layer 620, a risk of an electrical short-circuit between the shielding structure and the coil component 1000 may be decreased.

Figure 5:
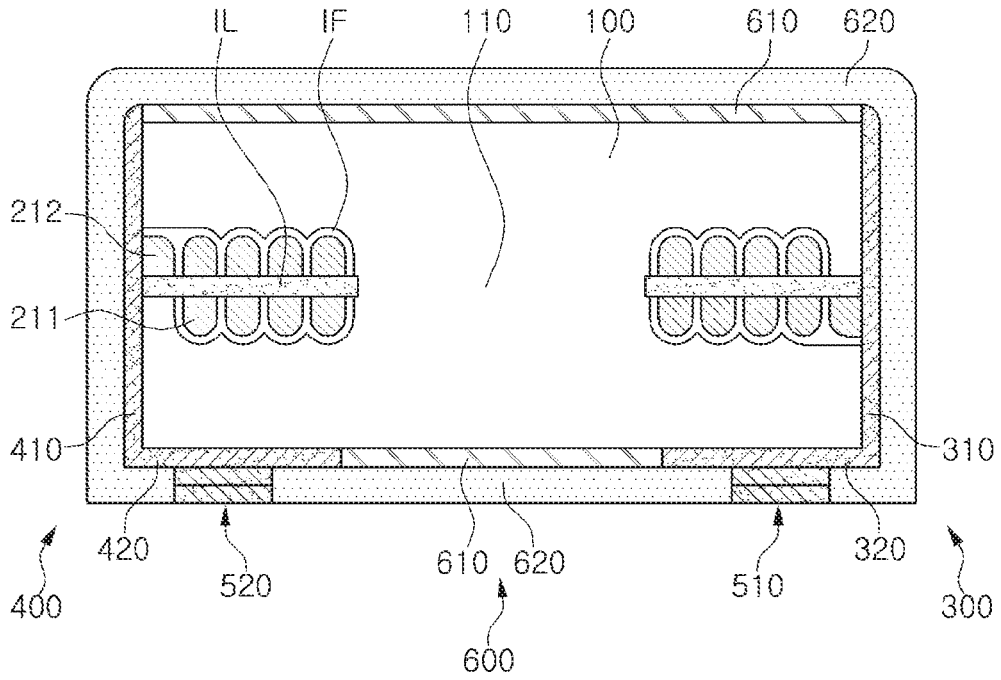
FIG. 5 is a cross-sectional view schematically illustrating a coil component according to another exemplary embodiment and corresponding to the cross-sectional view taken along line I-I' of FIG. 1.

FIG. 5 is a cross-sectional view schematically illustrating a coil component according to another exemplary embodiment, corresponding to the cross-sectional view taken along line I-I' of FIG. 1.

Referring to FIG. 5, comparing with the coil component according to the exemplary embodiment of FIG. 3, the component of FIG. 5 is different in that the through electrodes 510 and 520 have a different structure.

In detail, the through electrodes 510 and 520 applied to the present exemplary embodiment may include first layers coming in contact with extension portions 320 and 420 and second layers formed on the first layers, respectively. The first layer may contain nickel (Ni), and the second layer may contain tin (Sn).

Here, the first and second layers may be each formed by electroplating, but are not limited thereto.

Method of Manufacturing Coil Component

FIGS. 6A, 6B, 7A, 7B, 8A, 8B, 9A, 9B, 10A, and 10B are views illustrating sequential steps of a method of manufacturing a coil component according to the exemplary embodiment. More specifically, FIGS. 6A, 7A, 8A, 9A, and 10A are cross-sectional views sequentially illustrating the method of manufacturing a coil component according to the exemplary embodiment, each corresponding to the cross-sectional view taken along line I-I' of FIG. 1, and FIGS. 6B, 7B, 8B, 9B, and 10B are cross-sectional views sequentially illustrating the method of manufacturing a coil component according to the exemplary embodiment, each corresponding to the cross-sectional view taken along line II-II' of FIG. 1.

Figure 6A:
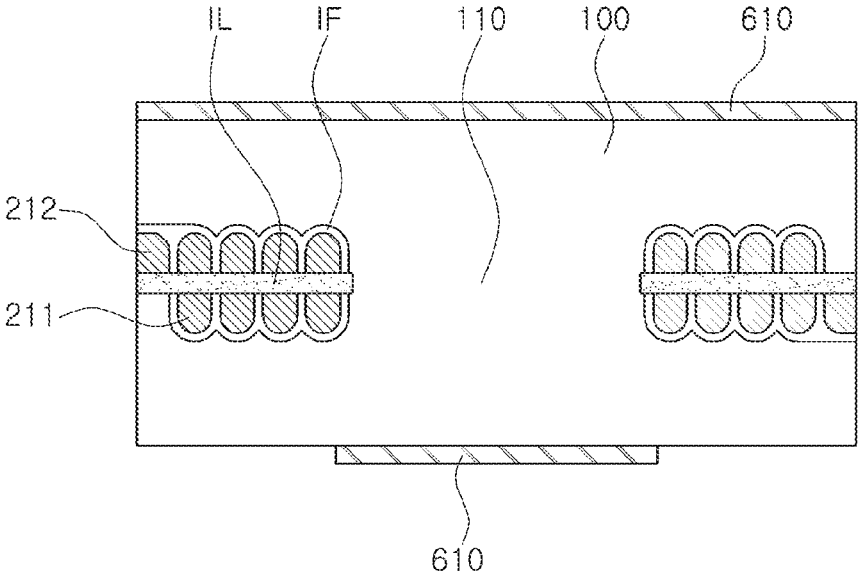
FIGS. 6A, 6B, 7A, 7B, 8A, 8B, 9A, 9B, 10A, and 10B are views illustrating sequential steps of a method of manufacturing a coil component according to the exemplary embodiment.
Figure 6B:
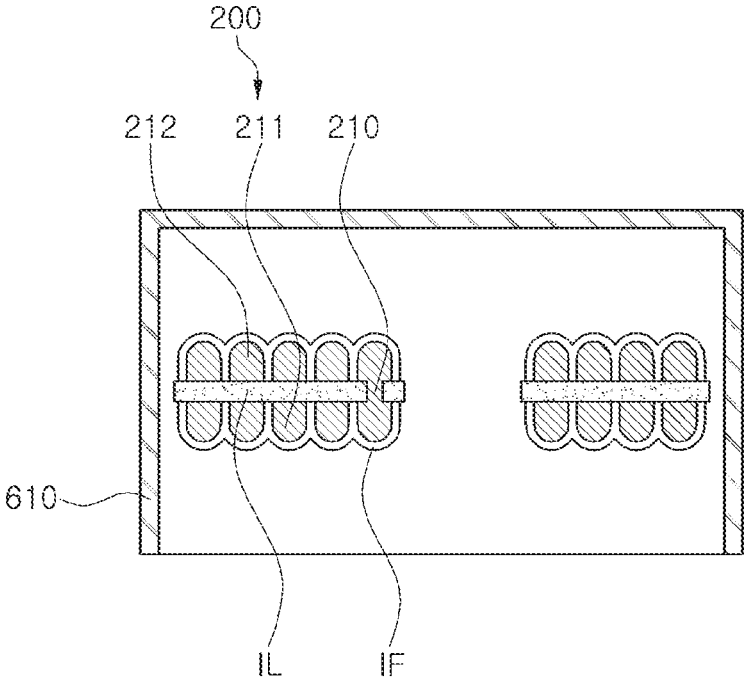

First, referring to FIGS. 6A and 6B, a body 100 in which a coil part 200 is embedded may be formed, and a plating prevention layer 610 is formed on a portion of a surface of the body.

A coil part 200 may include a first coil pattern 211, a second coil pattern 212, and a via 210. The coil part 200 may be formed by processing a via hole for forming a via in an internal insulating layer IL and then performing electroless plating and/or electroplating on the internal insulating layer IL.

A body 100 may be formed by processing a through hole for forming a core 110 in the internal insulating layer IL on which the coil part 200 is formed, and then, stacking at least one magnetic composite sheet on the internal insulating layer IL in which the through hole is formed. The magnetic composite sheet may contain metal magnetic powder and a thermosetting insulating resin. The metal magnetic powder may be exposed to a surface of the body 100 after curing the insulating resin.

A plating prevention layer 610 may be formed by stacking a material for forming a plating prevention layer on a region of the surface of the body 100 on which first and second plating electrodes 300 and 400 are not to be formed. Alternatively, the plating prevention layer 610 may be formed by stacking the material for forming the plating prevention layer on the entire surface of the body 100 and selectively removing the stacked material for forming the plating prevention layer 610 in a region of the surface in which the first and second plating electrodes 300 and 400 will be formed. In the latter case, the plating prevention layer 610 may be formed using an insulating material such as a dry film including a photosensitive insulating resin through a selective exposure and development method, but is not limited thereto.

As described above, since the first plating electrode 300 is composed of a first connection portion 310 formed on a first surface of the body 100 and a first extension portion 320 formed on a sixth surface of the body 100, and the second plating electrode 400 is composed of a second connection portion 410 formed on a second surface of the body 100 and a second extension portion 420 formed on the sixth surface of the body 100, the plating prevention layer 610 may be formed on third to fifth surfaces of the body 100 and a central portion of the sixth surface of the body 100.

Figure 7A:
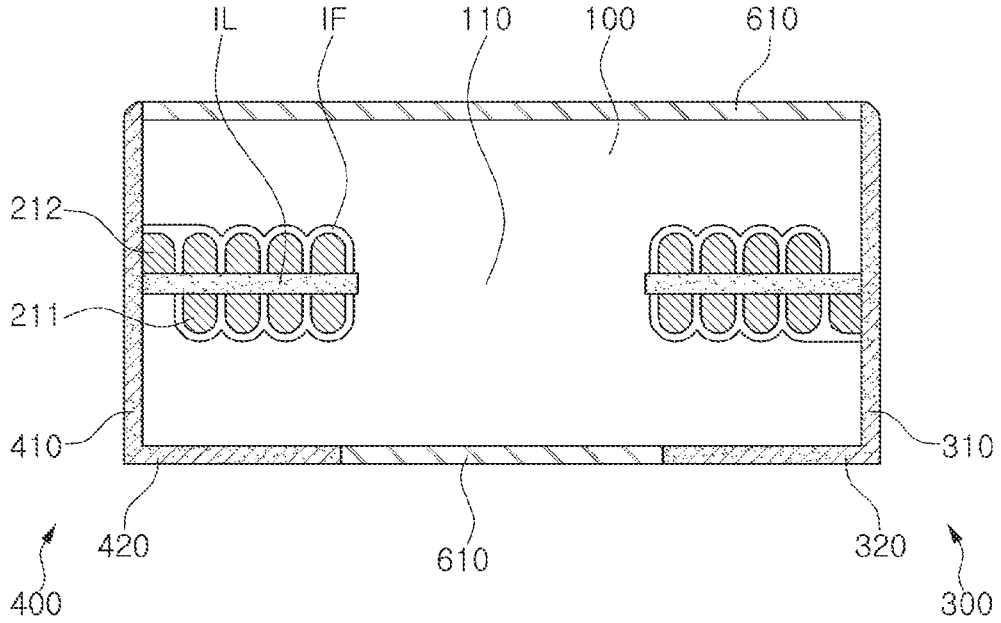
Figure 7B:
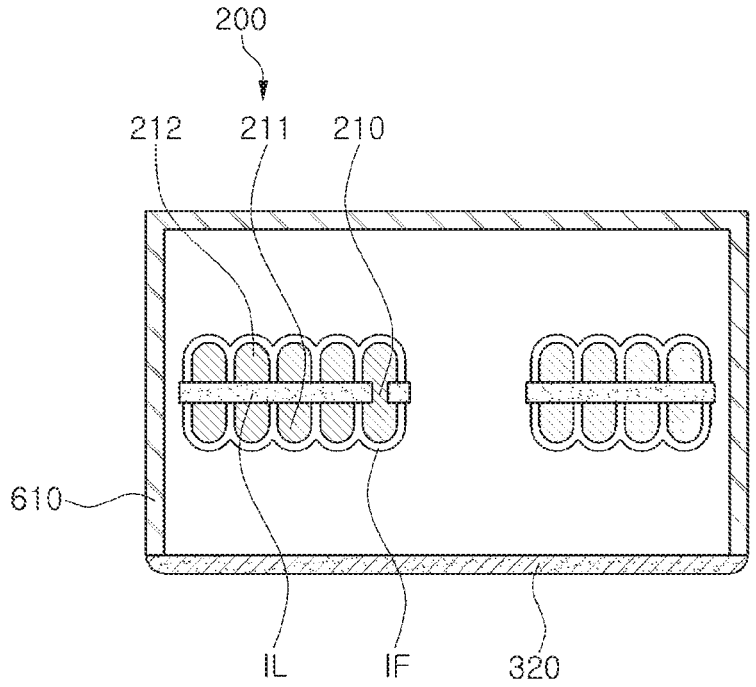

Next, referring to FIGS. 7A and 7B, plating electrodes 300 and 400 may be formed.

First and second plating electrodes 300 and 400 may be formed by electroplating on the first and second surfaces of the body 100 and outer regions of the sixth surface of the body 100 on which the plating prevention layer 610 is not formed. Therefore, the entire surface of the body 100 may be covered with the plating prevention layer 610 or the plating electrodes 300 and 400.

Figure 8A:
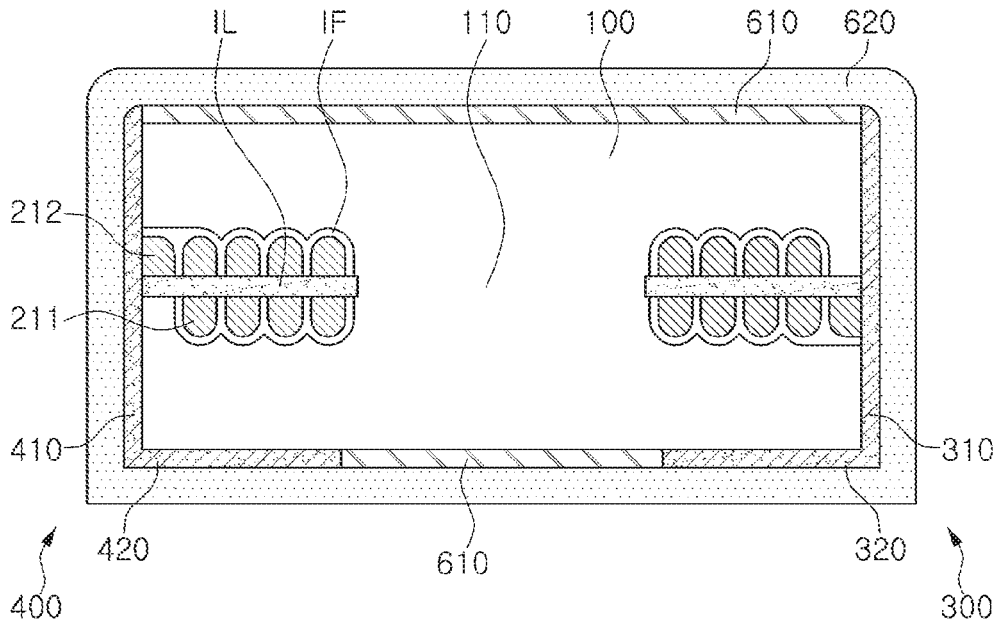
Figure 8B:
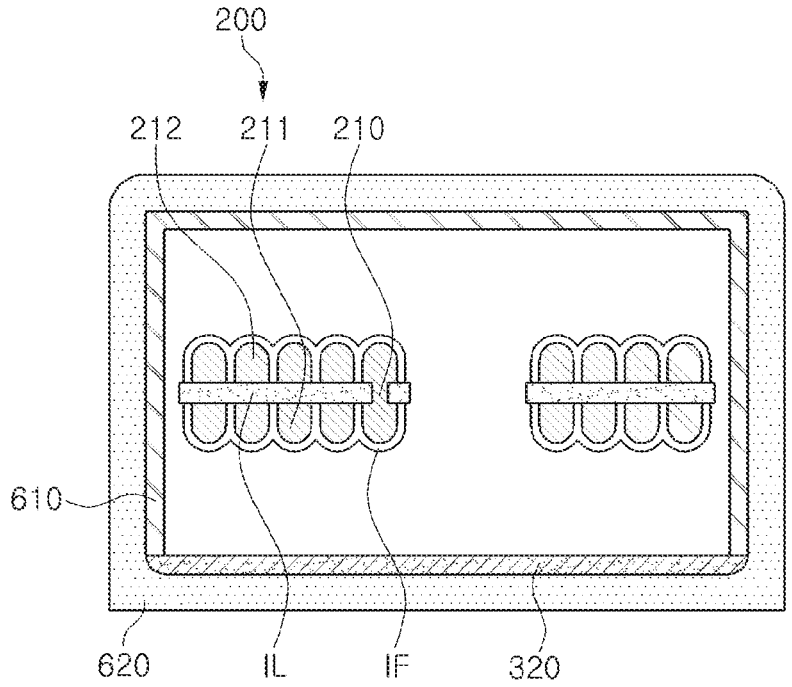

Next, referring to FIGS. 8A and 8B, a cover layer 620 may be formed.

The cover layer 620 may be formed on the entire surface of the body 100 to entirely cover the plating prevention layer 610 and the plating electrodes 300 and 400. The cover layer 620 may be formed by forming a first cover layer on the first to fifth surfaces of the body 100 except for the sixth surface of the body 100 and then overturning the body 110 and forming a second cover layer on the sixth surface thereof. Alternatively, the cover layer 620 may be simultaneously formed on the entire surface of the body 100 by dipping the body 100 in a liquid insulating resin for forming a cover layer.

Figure 9A:
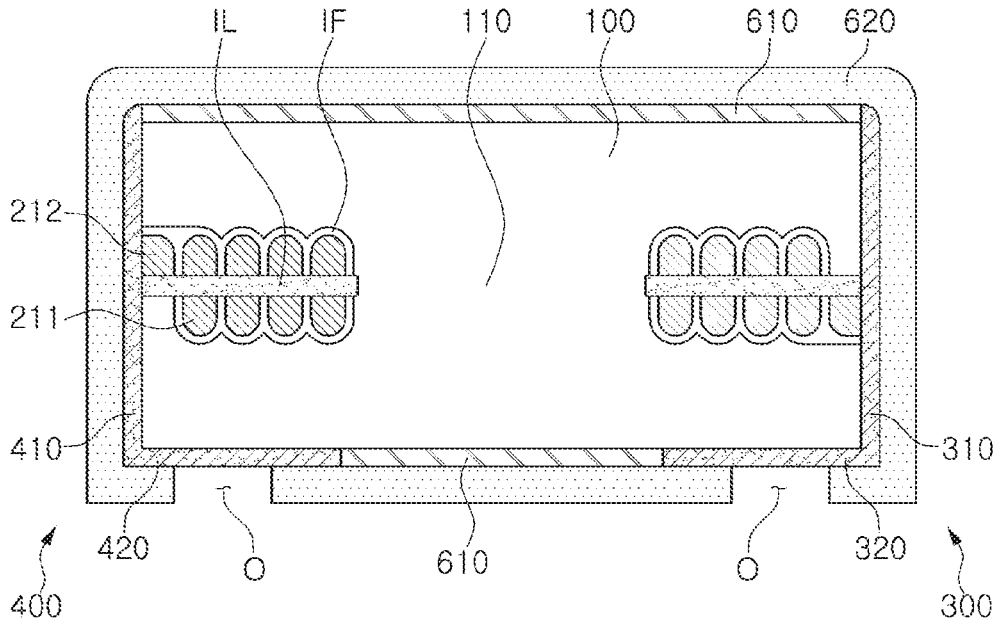
Figure 9B:
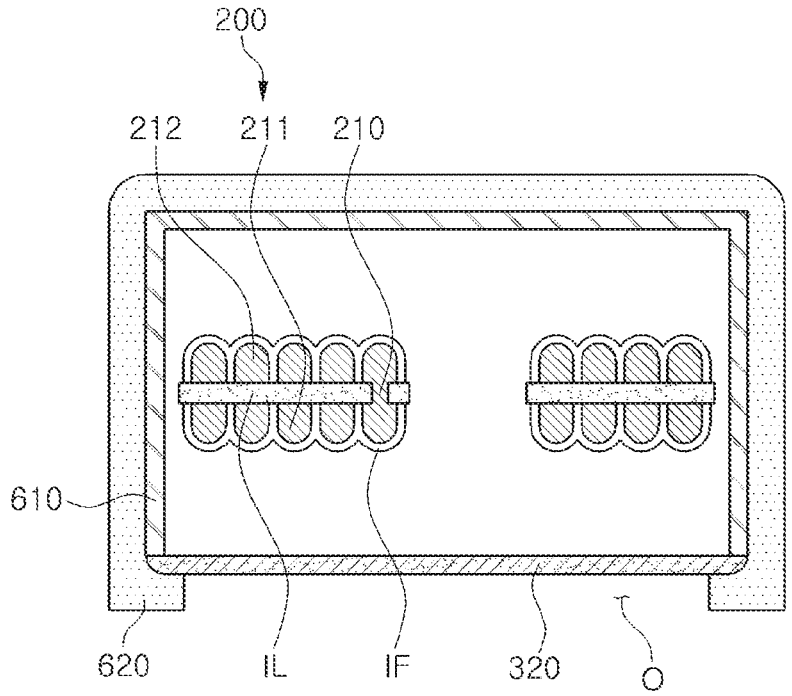

Next, referring to FIGS. 9A and 9B, opening portions may be processed in the cover layer.

The opening portions O may expose the first and second extension portions 320 and 420 to the outside, respectively. That is, the opening portions O may penetrate through portions of the cover layer 620 formed on the sixth surface of the body 100 to expose the first and second extension portions 320 and 420 to the outside.

The opening portions O may be formed in the cover layer 620 by a photolithography method when the cover layer 620 contains a photosensitive insulating resin. Alternatively, the opening portions O may be formed in the cover layer 620 by a sandblast method or a drilling method when the cover layer 620 contains a non-photosensitive insulating resin, for example, a thermosetting insulating resin.

Figure 10A:
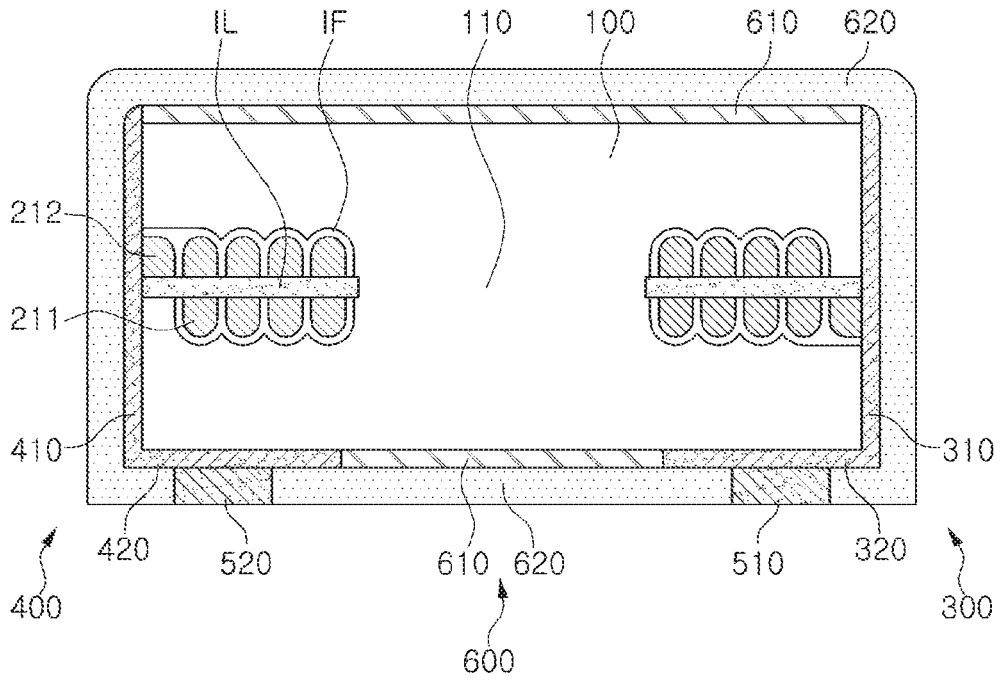
Figure 10B:
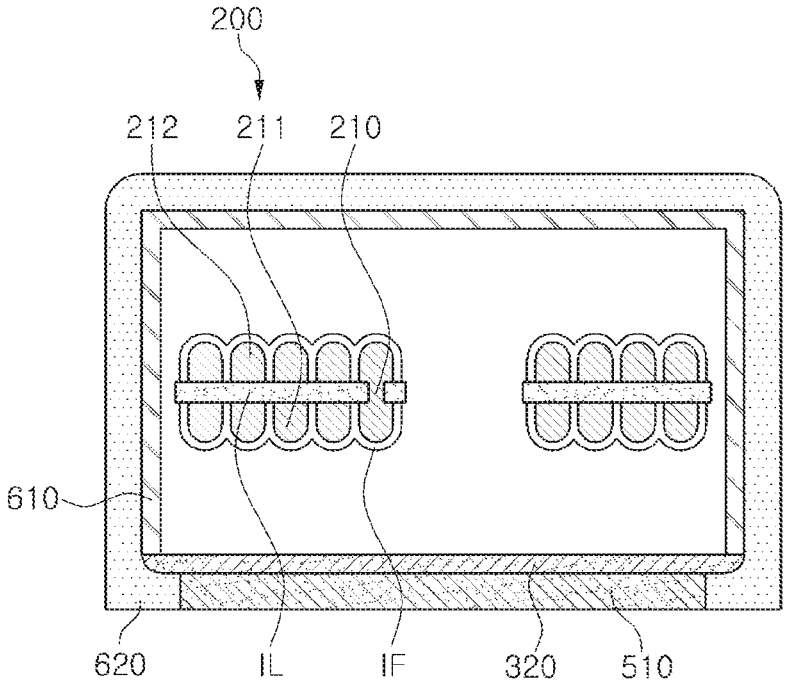

Next, referring to FIGS. 10A and 10B, through electrodes may be formed in the opening portions.

Through electrodes 510 and 520 may be formed by performing electroplating on the body 100 on which the opening portions O are formed. Alternatively, the through electrodes 510 and 520 may be formed by filling the opening portions O with a conductive paste.

As set forth above, according to exemplary embodiments, the shielding structure decreasing a leakage magnetic flux may be easily formed.

While exemplary embodiments have been shown and described above, it will be apparent to those skilled in the art that modifications and variations could be made without departing from the scope of the present invention as defined by the appended claims.

What is claimed is:

1. A coil component comprising:

a body;

a coil part embedded in the body;

an insulating layer covering the body;

first and second plating electrodes disposed between the body and the insulating layer, connected to the coil part, and disposed to be spaced apart from each other on one surface of the body; and first and second through electrodes penetrating through the insulating layer to thereby be connected to the first and second plating electrodes, respectively, wherein the insulating layer includes:

a plating prevention layer disposed on a surface of the body except for a region of the surface of the body on which the first and second plating electrodes are disposed; and a cover layer covering the plating prevention layer and the first and second plating electrodes such that at least one of the first or second through electrode penetrates through the cover layer.

2. The coil component of claim 1, wherein the first and second plating electrodes each contain copper (Cu).

3. The coil component of claim 1, wherein the first and second through electrodes each contain at least one of copper (Cu), nickel (Ni), tin (Sn), iron (Fe), platinum (Pt), and gold (Au).

4. The coil component of claim 1, wherein cross sections of the first and second through electrodes each include a curve.

5. The coil component of claim 1, wherein opposite ends of the coil part are exposed to opposing end surfaces of the body, and the first and second plating electrodes respectively include:

first and second connection portions each disposed on a respective one of the opposing end surfaces of the body; and first and second extension portions each extended from a respective one of the first and second connection portions and both disposed to be spaced apart from each other on the one surface of the body.

6. The coil component of claim 5, wherein the first connection portion and the first extension portion are formed integrally with each other, and the second connection portion and the second extension portion are formed integrally with each other.

7. The coil component of claim 1, wherein the body has the one surface and another surface opposing the one surface and further includes an internal insulating layer embedded in the body, and the coil part includes:

a first coil pattern disposed on one surface of the internal insulating layer;

a second coil pattern disposed on another surface of the internal insulating layer; and a via penetrating through the internal insulating layer and connecting the first and second coil patterns to each other.

8. The coil component of claim 7, wherein the first and second coil patterns form a single coil.

9. The coil component of claim 7, further comprising an insulating film disposed along surfaces of the first coil pattern, the internal insulating layer, and the second coil pattern.

10. A coil component comprising:

a coil part embedded in a body and having ends exposed to opposing end surfaces of the body;

first and second plating electrodes each disposed on a respective end surface of the opposing end surfaces of the body to connect to a respective end of the coil part; and an insulating layer disposed on the first and second plating electrodes, wherein the insulating layer includes:

a plating prevention layer disposed on a surface of the body except for a region of the surface of the body on which the first and second plating electrodes are disposed; and a cover layer covering the plating prevention layer and an entire surface of each of the first and second plating electrodes parallel to the opposing end surfaces of the body.

11. The coil component of claim 10, wherein the body of the coil component has a hexahedral shape, and the insulating layer covers at least a portion of each external surface of the body.

12. The coil component of claim 10, wherein the insulating layer covers an entirety of all but one external surface of the body.

13. The coil component of claim 10, further comprising:

first and second through electrodes respectively connected to the first and second plating electrodes and both exposed through a same outer surface of the coil component.

14. The coil component of claim 13, wherein the first and second plating electrodes each extend from the respective end surface of the opposing end surfaces of the body to a same other surface of the body connecting the opposing end surfaces, and the first and second through electrodes are directly disposed on portions of the first and second plating electrodes extended to the same other surface of the body.

15. The coil component of claim 13, wherein each of the first and second through electrodes includes a first layer including nickel (Ni) and contacting a respective one of the first and second plating electrodes, and a second layer including tin (Sn) and contacting the first layer.

* * * * *